United States Patent [19]

Apodaca

[11] Patent Number: 4,513,170

[45] Date of Patent: Apr. 23, 1985

[54] STRIPPABLE SHIELDED ELECTRICAL CABLE

[75] Inventor: Jeffrey S. Apodaca, Los Angeles, Calif.

[73] Assignee: Thomas & Betts Corporation, Raritan, N.J.

[21] Appl. No.: 470,663

[22] Filed: Feb. 28, 1983

[51] Int. Cl.[3] ..... H01B 7/08; H01B 11/06

[52] U.S. Cl. ..... 174/36; 174/115; 174/117 F

[58] Field of Search ..... 174/36, 115, 117 F

[56] References Cited

U.S. PATENT DOCUMENTS

| | | | |
|---|---|---|---|
| 2,805,183 | 9/1957 | Higgins | 154/53.5 |
| 2,940,884 | 6/1960 | White | 154/53.5 |
| 3,173,991 | 3/1965 | Breakfield, Sr. | 174/117 |
| 3,576,723 | 4/1971 | Angele et al. | 204/30 |
| 3,582,532 | 6/1971 | Plummer | 174/36 |
| 3,612,743 | 10/1971 | Angele et al. | 174/36 |
| 3,612,744 | 10/1971 | Thomas | 174/36 |
| 3,833,755 | 9/1974 | Soelberg | 174/117 |
| 4,154,977 | 5/1979 | Verma | 174/117 F |
| 4,209,215 | 6/1980 | Verma | 339/17 |
| 4,300,017 | 11/1981 | Segretto et al. | 174/36 |

*Primary Examiner*—A. T. Grimley
*Assistant Examiner*—Morris H. Nimmo
*Attorney, Agent, or Firm*—Robert M. Rodrick; Salvatore J. Abbruzzese

[57] ABSTRACT

The cable includes a flat cable including a plurality of elongate conductors enclosed in an insulative casing and a drain wire supported thereon. A wire mesh ground shield overlies the casing in contact with the drain wire along its length. An upper layer of insulation overlies the ground shield and includes at one of its marginal edges a strip of insulative material extending longitudinally in registry with the drain wire. The strip provides a barrier against bonding of the insulative layer to the drain wire and to the casing material adjacent the drain wire thereby preventing pullout of the drain wire during separation of the cable core, wire mesh and layer for termination purposes. Strippability of the cable is facilitated by the non-adhesion to the strip whereby a marginal access region is provided for grasping the mesh, cable core and layer.

17 Claims, 4 Drawing Figures

STRIPPABLE SHIELDED ELECTRICAL CABLE

FIELD OF THE INVENTION

This invention relates to multiconductor electrical cable and, more particularly, to an improved strippable, shielded cable.

BACKGROUND OF THE INVENTION

Flat, multiconductor, flexible cable has come into extensive use and generally comprises a ribbon of tape of an insulative material enclosing a plurality of round or thin flat conductors disposed in spaced, parallel relation. In certain applications, such flat cables are electrically shielded to prevent cross-talk or to reduce electrostatic interference. Shielded flat cable, sometimes referred to as ground plane cable, is made, for example, by laminating or extruding a wire mesh or perforated metal foil to one or both sides of the cable with an outer layer of insulative material being applied over the shield. Connection of the shield to a ground or drain conductor is obtained by exposing a portion of one or more of the conductors such that the shield is pressed into continuous contact therewith along the length of the cable during assembly.

In mass terminating shielded electrical cable, problems have been encountered, especially with insulation displacement techniques, as the shield presents an impediment to ready termination. In common practice, the shield is stripped or peeled from the cable and the conductors and shield are then terminated separately. The dilemma faced by the practitioner is that the cable components, namely, the cable core with conductors, ground shield and overlying outer insulation are normally required to have sufficiently strong bonding or adhesion to each other so as to withstand temperature variations or physical movements such as flexing without resulting in separation while yet the bond strength between such components should be low enough to facilitate separation when termination is desired. Another problem in separating shielded cable components is encountered in assuring a reliable connection to the drain wire. In exposing portions of the drain wire to make contact with the ground shield, the drain wire is thereby not fully surrounded by the casing insulation in the cable core. Accordingly, its retention capability in the cable core is weakened. In stripping the shield from the cable core, inadvertent pulling of the drain wire from the cable core can result in failure to make a connection thereto in particular where all the cable conductors are mass terminated with insulation displacement techniques. It is therefore desirable to provide a shielded cable, readily strippable for mass termination which overcomes the problems in the field.

SUMMARY OF THE INVENTION

It is an object of the present invention to provide an improved shielded electrical cable.

It is another object of the present invention to provide an improved shielded electrical cable inclusive of means to facilitate stripping thereof.

In accordance with the invention, a shielded electrical cable comprises a plurality of elongate, spaced electrical conductors. A casing of electrically insulative material encloses the conductors with at least one of such conductors having an exposed portion free of casing material. An electrically conductive shield member adheringly overlies the casing and such shield member is in electrical contact with the exposed conductor portion. A layer of electrical insulation adheringly overlies the conductive shield member. Barrier means is disposed between the layer and the exposed conductor portion, in registry with such exposed conductor portion for providing a non-adhered relation between the layer and the exposed conductor portion to facilitate separation therebetween.

In the preferred arrangement, the exposed conductor constitutes a drain wire and the shield member comprises a wire mesh. Adhesion between the layer and the casing is effected by a bond therebetween through the interstices of the mesh. The barrier means comprises a strip of insulative material adhered on one surface to the layer, the opposing surface of the strip being non-adhered to the wire mesh, drain wire or portions of the casing material adjacent the drain wire.

DETAILED DESCRIPTION OF THE PREFERRED EMBODIMENTS

Figure 1:
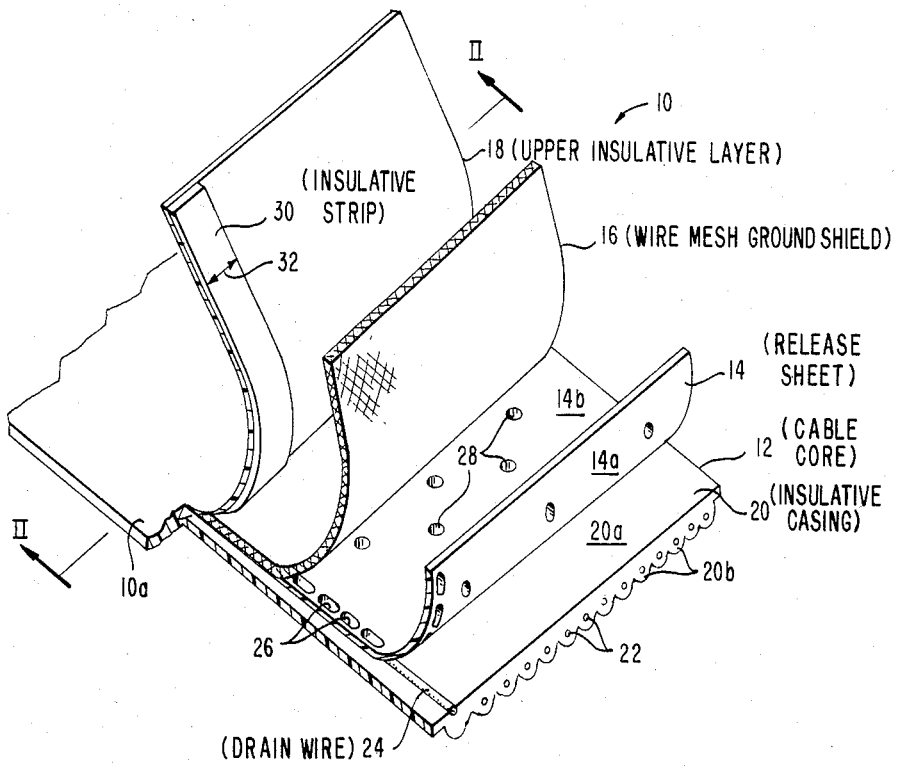
FIG. 1 is a perspective view showing a strippable, shielded, multiconductor cable of the present invention with various layers thereof being illustrated in a stripped position.
Figure 2:
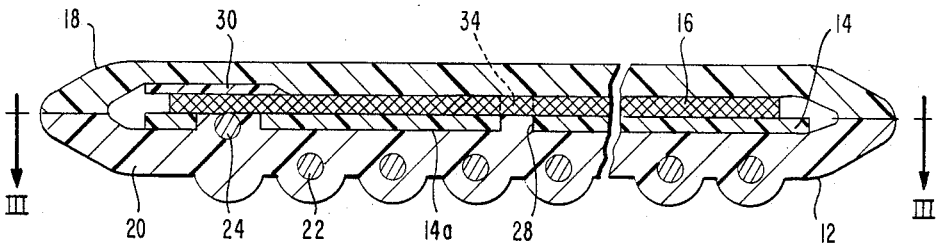
FIG. 2 is a sectional view as seen along the line II—II of FIG. 1.

Referring now to FIGS. 1 and 2, there is shown in accordance with a preferred embodiment of the invention a strippable, shielded, multiconductor flat electrical cable, generally designated as 10. The cable 10 comprises a multiconductor cable core 12, a release sheet 14, a conductive ground shield 16 and an upper insulative layer 18. The cable core 12 is of conventional ribbon-like construction including a generally flat casing 20 of polyvinylchloride (PVC) or other suitable insulative material enclosing a plurality of elongate, parallel-spaced conductors 22. The upper surface **20*a* of casing 20 is substantially flat while the lower surface defines a plurality of crests 20*b* about the conductors 22. Imbedded in the upper casing surface 20*a* and extending longitudinally parallel with the conductors 22 is a drain wire 24, the upper longitudinal extent of which is exposed for contact with the ground shield 16**, as will be described.

Figure 3:
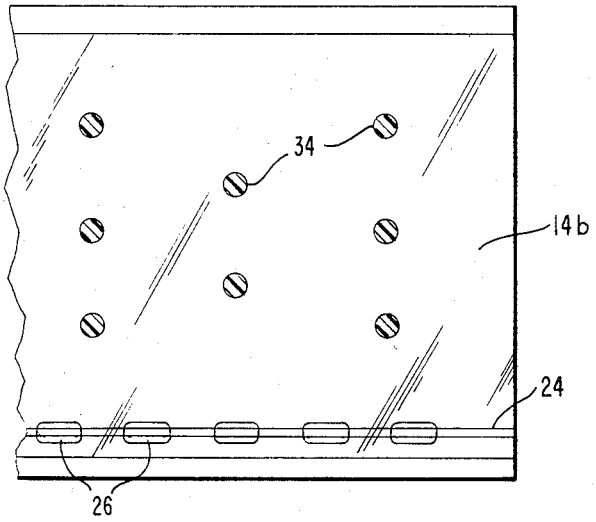
FIG. 3 is a sectional view as seen along the line III—III of FIG. 2.

The release sheet 14 comprises a sheet of polyester, such as Mylar (registered trademark of Du Pont) or other suitable material and extends nearly across the entire width of the cable core 12. The release sheet is preferably transparent and has a thickness of approximately 0.002 inch. At the lateral edge of the sheet adjacent the drain wire 24, the sheet has a series of longitudinally spaced cutouts 26 extending therethrough, such cutouts 26 being in longitudinal registry with the drain wire 24. The cutouts 26, as shown in FIG. 3, define alternating openings and coverings for the drain wire 24, the drain wire being exposed for contact with the ground shield 16 at the openings and covered therebetween. The cutouts 26 are provided to establish the desired contact between the drain wire 24 and the ground shield, albeit intermittently, and the coverings provide for further protection against drain wire pull-out upon cable stripping, as will be detailed. The release sheet 14 has a plurality of apertures 28 extending therethrough to provide a means for creating a light bond between the upper layer 18 and the cable core insulative casing 20 during assembly of the cable 10. In the preferred arrangement, the lower surface 14*a* of the sheet 14 is coated with a suitable release agent (e.g., Frekote PVC release agent, commercially available from Frekote, Boca Raton, Fla.) to prevent adhesion between the lower sheet surface 14*a* and the upper casing surface 20*a*. The upper sheet surface 14*b* is normally left uncoated.

The ground shield 16, preferably a sheet of wire mesh or other permeable conductive material, also nearly extends across the width of the cable core 12, at least sufficiently wide to overlie the cable core conductors 22 and the drain wire 24.

The upper layer 18 is preferably formed of polyvinylchloride (PVC) although other suitable materials may be used. In accordance with the invention, disposed near the marginal edge of the layer 18 is a strip 30 of insulative material. The strip 30 is arranged to overlie and extend in longitudinal registry with the drain wire 24. The strip 30 is formed to have a transverse extent 32 less than the layer 18 and greater than the diameter of the drain wire 24. Preferably the width 32 of the strip is greater than the transverse dimension of the cutouts 26. In the preferred form, the strip 30 is made of polyester (such as Mylar) and approximately 0.001 inch in thickness.

The cable 10 is fabricated by arranging the components herein described in the orientation and disposition illustrated and extruding same to produce the final cable construction. It should be appreciated that other suitable processing techniques, such as lamination, may also be employed. During fabrication, the extrusion takes place at a temperature at or near the melting temperature of PVC. Accordingly, as shown in FIG. 2, the outer lateral marginal portions of the upper layer 18 and the cable core casing 20 are bondably joined, the layer 18 and casing 20 being further joined by small bonds 34 through the apertures 28 in the release sheet 14 and through the interstices of the wire mesh ground shield 16. Intermittent longitudinal contact between the drain wire 24 and the wire mesh ground shield 16 is established through the cutouts 26 in the release sheet 14.

As the lower surface 14*a* of the release sheet 14 contains a coating of release agent, there is no adhesion between the sheet 14 and the casing upon extrusion. There is light adhesion between the upper surface 14*b* of the release sheet and the wire mesh 16 and also between the wire mesh 16 and the layer 18, except at the area in registry with the strip 30, as a result of the compression during the extrusion process and melting of the PVC layer 18 onto and through the mesh 16 to the sheet 14. The bonding of the core 12 and upper layer 18 through bonds 34 and the light adhesion among the sheet 14, wire mesh shield 16 and upper layer 18 are desirable in providing sufficient bonding integrity to enable the cable 10 to be subjected to flexing conditions and temperature variations without separation.

During the extrusion process, the strip 30 is adheringly joined to the layer 18 but serves as a barrier preventing flow of PVC from the layer 18 to the core casing 20. Accordingly, along an area in registry with the strip 30, there is no bond between the layer 18 and the core casing 20. Also, as a result of the prevention of such PVC flow, there is virtually no adhesion along the strip area between the strip 30 and the mesh 16, the drain wire 24 and the portions of the core casing 20 adjacent the drain wire 24 that are exposed through the cutouts 26. Any adhesion that might exist in the strip area is negligible and is a result of the extrusion pressure. Such cable construction not only enhances stripping as will now be described, but prevents pullout of the drain wire 24 from the cable core during stripping.

Referring again to FIG. 1, stripping is effected by first removing, as by cutting, both lateral margins 10*a* of the cable, preferably cutting into the transverse edges of the release sheet 14 and mesh 16. The cable core 12 is readily stripped from the adhered composite of the sheet 14, mesh 16 and layer 18 as the lower sheet surface 14*a* with release coating thereon is not adhered to the casing 20 and the small bonds 34 are readily manually broken without damage to the insulation of layer 18 or casing 20. As bonding of the casing 20 portions adjacent the drain wire 24 through sheet cutouts 26 to the layer 18 has been prevented by the strip 30 and as the strip 30 itself is in substantial non-adherence to the drain wire and adjacent casing portions, stripping the cable core 12 is accomplished without detrimental pullout of the drain wire from the cable core 12. As a further advantage of the strip 30, separation of the layer 18, wire mesh 16 and release sheet 14 is also facilitated. As there is virtually no adhesion between the lower surface of the strip 30 and the mesh 16, an access area is provided allowing easy grasp of the marginal edges of both the layer 18 and the mesh 16 whereby full stripping therebetween may then be effected. Separation of the layer 18 and mesh 16 effectively also releases the release sheet 14 from the mesh 16. In such condition the conductors 22 and drain wire 24 in the cable core 12 and the ground shield mesh 16 may be thus separately terminated.

Figure 4:
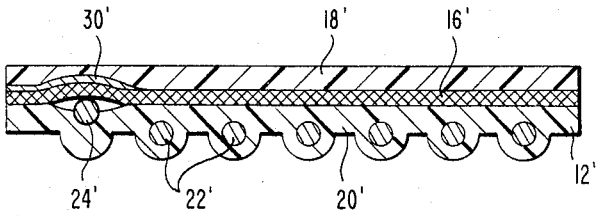
FIG. 4 is a sectional view, similar to FIG. 2, showing a modified form of a strippable cable.

Having described the preferred embodiment of the invention herein, it should be appreciated that other variations may be apparent to one skilled in the art without departing from the contemplated scope. For example, as depicted in FIG. 4, a shielded cable 10' may be constructed similar to cable 10 described hereinabove, but without the release sheet 14. In the modified cable 10', the upper insulative layer 18' and the cable core casing 20' are in adhered relation to the ground shield mesh 16' by virtue of the fabrication process which may be through extrusion or lamination techniques. As in the previously described cable construction, a polyester strip 30' is provided at a cable margin between the insulative layer 18' and the ground mesh 16' in longitudinal registry with the drain wire 24' which is in contact along its length with the ground mesh 16'. During fabrication, bonding between layer 18' and the casing 20' at the strip area and between the layer 18' and the drain wire 24' is prevented by the strip 30'. The lower surface of the strip 30' may also be coated with a release agent further inhibiting adhesion to the strip 30'. Accordingly, separation of the cable core 12' from the ground mesh 16' may be effected without damage to the drain wire 24' and the upper layer 18' may be readily stripped from the mesh 16' by way of the access area provided by the marginal strip 30'. While use of a strip such as 30 or 30' on the upper insulation is preferred, in the practice of the invention other means to provide a non-adhered relation between the cable upper insulation layer and both the drain wire and cable core casing adjacent the drain wire may include suitable barriers provided on or as part of the wire ground mesh.

Various other modifications to the foregoing disclosed embodiment will be evident to those skilled in the art. Thus, the particularly described preferred embodiment is intended to be illustrative and not limited thereto. The true scope of the invention is set forth in the following claims.

I claim:

1. A shielded electrical cable comprising:

a plurality of elongate, spaced electrical conductors;

a casing of electrically insulative material enclosing said conductors, at least one of said conductors having an exposed portion free of said casing material;

an electrically conductive shield member adheringly overlying said casing and in electrical contact with said exposed conductor portion;

a layer of electrical insulation adheringly overlying said conductive shield member; and barrier means disposed between said layer and said exposed conductor portion and in registry exclusively with such exposed conductor portion for providing a non-adhered relation between said layer and said exposed conductor portion.

2. A shielded electrical cable according to claim 1, wherein said barrier means is disposed between said layer and said electrically conductive shield member.

3. A shielded electrical cable according to claim 2, wherein said barrier means is disposed on said layer.

4. A shielded electrical cable according to claim 1, wherein said barrier means comprises a strip of material extending longitudinally in registry with said conductor having such exposed portion.

5. A shielded electrical cable according to claim 4, wherein said strip is disposed on said layer and comprises insulative material.

6. A shielded electrical cable according to claim 5, wherein said strip comprises a first surface in adhered relation to said layer and an opposed surface in non-adhered relation to said shield member and said exposed conductor portion.

7. A shielded electrical cable according to claim 6, wherein said strip has a width extending transversely to said longitudinal extent of said conductors being less in extent than the width of said layer.

8. A shielded electrical cable according to claim 7, wherein said casing is generally flat, said conductors being disposed in substantially parallel relation therein, said conductor having such exposed portion being disposed adjacent a marginal edge of such casing, said strip being disposed in registry therewith adjacent a marginal edge of said layer.

9. A shielded electrical cable according to claim 4, wherein said strip has a transverse extent greater than the cross-sectional extent of said conductor having said exposed portion such that said strip overlies a portion of said casing adjacent said exposed conductor portion and is in non-adhered relation to such adjacent casing portion and to said exposed conductor portion.

10. A shielded electrical cable according to claim 9, wherein said electrically conductive shield member comprises wire mesh and wherein said layer is adhered to said casing through said mesh except at said casing portion adjacent said exposed conductor portion in registry with said strip.

11. A shielded electrical cable according to claim 10, wherein said strip comprises insulative material having a first surface adhered to said layer and a second surface in non-adhered relation to said exposed conductor portion, to said casing portion adjacent said exposed conductor portion and to said wire mesh.

12. A shielded electrical cable comprising:

a plurality of elongate, spaced electrical conductors;

a casing of electrically insulative material enclosing said conductors;

a drain wire on said casing and extending generally parallel with said conductors;

an electrically conductive shield of permeable material overlying said casing and in electrical contact with said drain wire;

a layer of electrical insulation overlying said shield and being bonded to said casing through said permeable material of said shield; and a strip of insulative material disposed between said layer and said shield and in registry with said drain wire, said strip having a surface adhered to said layer and an opposed surface in substantially non-adhered relation to said shield and providing a barrier preventing bonding between said layer and said casing adjacent said drain wire.

13. A shielded electrical cable according to claim 12, wherein said shield permeable material comprises a wire mesh.

14. A shielded electrical cable according to claim 13, wherein said strip is elongate and has a transverse expanse less than the transverse expanse of said layer and greater than the cross-section of said drain wire.

15. A shielded electrical cable according to claim 14, wherein said casing is generally flat and said strip and said drain wire are disposed adjacent a marginal edge of layer and casing, respectively.

16. A strippable, shielded electrical cable comprising:

a plurality of elongate conductors arranged in spaced parallel relation;

a casing of generally flat electrically insulative material enclosing said conductors;

a drain wire on said casing extending adjacent to one marginal edge of said casing;

a release sheet of insulative material overlying said casing and having a surface in substantially non-adhered relation to said casing, said release sheet having a plurality of openings extending therethrough, said release sheet having means exposing said drain wire;

an electrical shield including a layer of electrically conductive wire mesh overlying said release sheet, in adherence with a second surface of said release sheet and in contact with said exposed drain wire;

a layer of electrical insulation overlying said shield and being bonded to said casing through said wire mesh and through said openings in said release sheet; and a strip of insulative material on said layer extending longitudinally in registry with said drain wire, said strip being in substantially non-adhered relation to said wire mesh shield, to said drain wire and to a portion of said casing adjacent said drain wire.

17. A strippable, shielded electrical cable according to claim 16, wherein said release sheet exposing means includes a plurality of cutout portions extending longitudinally intermittently along the length of said sheet adjacent a marginal sheet edge and in registry with said drain wire, defining thereby alternating exposed and covered drain wire portions such that said drain wire intermittently contacts said wire mesh along its length.

* * * * *